United States Patent [19]

Bastiaans et al.

[11] 3,999,020

[45] Dec. 21, 1976

[54] TRANSDUCER WITH VARIABLE FREQUENCY RESPONSE

[75] Inventors: Cedric R. Bastiaans, Brown Deer; Joseph J. Chladil, Sr., Milwaukee, both of Wis.

[73] Assignee: Koss Corporation, Milwaukee, Wis.

[22] Filed: Oct. 29, 1975

[21] Appl. No.: 626,788

[52] U.S. Cl. ..... 179/180; 179/1 D; 179/115.5 R

[51] Int. Cl.[2] ..... H04R 1/28

[58] Field of Search ..... 179/180, 182 R, 156 R, 179/1 D

[56] References Cited

UNITED STATES PATENTS

| | | | |
|---|---|---|---|
| 3,061,690 | 10/1962 | Swinehart | 179/180 X |
| 3,617,654 | 11/1971 | Heidrich | 179/180 X |
| 3,798,393 | 3/1974 | Gorike | 179/180 X |

*Primary Examiner*—William C. Cooper
*Attorney, Agent, or Firm*—Quarles & Brady

[57] ABSTRACT

An audio transducer for a headphone includes ports which couple the rear of the transducer diaphragm to the interior of the cup. A resilient acoustic damping material is placed over the ports and is variably compressed by an adjustable clamp to provide a selectable frequency response curve. Two embodiments of the adjustable clamp are shown, as well as the coupling means which extends through an opening in the headphone cup to allow convenient adjustment by the user.

15 Claims, 6 Drawing Figures

TRANSDUCER WITH VARIABLE FREQUENCY RESPONSE

BACKGROUND OF THE INVENTION

The field of the invention is audio transducers, and particularly, audio transducers for high fidelity headphones used to reproduce stereophonic or quadraphonic program material.

A number of commercially available headphone structures provide the listener with adjustments which allow him to tailor the response of the headphones to his own particular tastes. For example, volume controls have been mounted in the cups of a number of commercially available headphones, such as the Models HV/1LC, K/6LC and K/6LCQ manufactured by the Koss Corporation, to provide the listener with convenient means for adjusting the level of the reproduced sound and for adjusting the balance between channels. Also, means for mixing and phase shifting the audio channels before application to the transducers have been provided in commercially available headphones, such as the Models Phase/2 and Phase/2+2 manufactured by the Koss Corporation, to electronically simulate a variety of listening conditions.

Although listeners universally demand that quality headphones have a broad frequency response, listeners quite often establish very definite tastes with respect to the shape of the frequency response curve within that operating range. The low frequency, or bass response of a quality headphone is adjusted during manufacture by well known acoustic tuning and damping techniques. As a result, a headphone with a relatively "flat" bass response can be constructed, or with proper damping, a headphone with "boosted" bass response can be constructed. A listener may develop a taste for either type of headphone, depending, for example, on the type of program material being reproduced. The devotee of popular music may prefer a headphone with boosted bass response, whereas the connoisseur of classical music may prefer a headphone having a more realistic, flat bass response.

SUMMARY OF THE INVENTION

The present invention relates to a headphone having a readily adjustable frequency response, and more specifically, to a headphone in which means are provided on each cup for manually adjusting the frequency response of the audio transducer contained therein by selectively compressing damping material disposed over ports which communicate with the rear of the transducer diaphragm.

Audio transducers for headphones include a magnetic circuit having an annular air gap into which a voice coil supported by a reciprocatably mounted diaphragm is disposed. The audio transducer is typically mounted within a cup and the front surface of the diaphragm is coupled to the ear canal of the listener. As is well known in the art, the frequency response of a headphone is determined by a number of factors such as the mass and compliance of the diaphragm, the size and position of the various cavities which couple to the diaphragm, and the leakage between the headphone cup and the listener's head. In most transducer structures an annular chamber is formed behind the diaphragm and it is common practice to provide a number of vent holes, or ports, which couple this chamber to the interior of the headphone cup. The frequency response of the headphone can be altered considerably, particularly at lower frequencies by altering the acoustical resistance of these ports with an acoustic damping material such as porous rubber or plastic.

The present invention resides more specifically in an acoustic damping material made of a resilient material which is disposed over the ports that couple to the rear of the diaphragm, an adjustable clamp which is mounted to the transducer and which applies an adjustable compressive force to the damping material to determine its acoustical resistance, and coupling means connected to the adjustable clamp and extending through an opening in the headphone cup to provide a means for manually operating the adjustable clamp.

A general object of the invention is to provide a headphone in which the user can select a frequency response suitable to his own tastes.

Another object of the invention is to provide a means for predictably altering the frequency response of an audio transducer. The range over which the frequency response can be altered by the adjustable clamp is determined by factors which are relatively fixed, such as the dimensions of the annular chamber and the cross sectional area of the ports. The ports are spaced concentrically about a central sound emitting axis and the adjustable clamp includes a circular compression plate which is mounted to a threaded shaft, concentric with the sound emitting axis. The threaded shaft is received in a threaded opening in the back of the transducer and by rotating the shaft, the resilient damping material disposed over the ports is adjustably compressed by the compression plate. Once the shaft is set by the user at the desired position, it remains in that position and the frequency response of the headphone is thus selectively fixed.

A more specific object of the invention is to provide an adjustable clamp which is easily and conveniently operated by the user of the headphones. Although the shaft may be extended to the exterior of the headphone cup where it is accessible for rotation by the user, a much preferred structure includes a compression plate having a contoured surface that engages and variably compresses the resilient damping material as a function of its circumference. A lever mechanism is fastened to the contoured compression plate and it extends through an opening in the headphone cup to allow rotation of the contoured compression plate about the sound emitting axis. By using the contoured compression plate, only a few degrees of rotation is needed to substantially alter the frequency response of the headphones. As a result, the lever mechanism may be extended radially outward from the sound emitting axis through a slot in the perimeter of the headphone cup where it is readily accessible to the user.

Another more specific object of the invention is to provide a means which allows the manual adjustment of the frequency response according to a selected "taper". Just as the resistance contour of a variable resistor can be selected to provide a desired taper, the shape of the contoured surface on the compression plate determines the rate at which the frequency response is altered as a function of the lever mechanism position.

The foregoing and other objects and advantages of the invention will appear from the following description. In the description reference is made to the accompanying drawings which form a part hereof, and in which there is shown by way of illustration preferred embodiments of the invention. Such embodiments do not necessarily represent the full scope of the invention, and reference is therefore made to the claims herein for interpreting the breadth of the invention.

DESCRIPTION OF THE PREFERRED EMBODIMENTS

Figure 1:
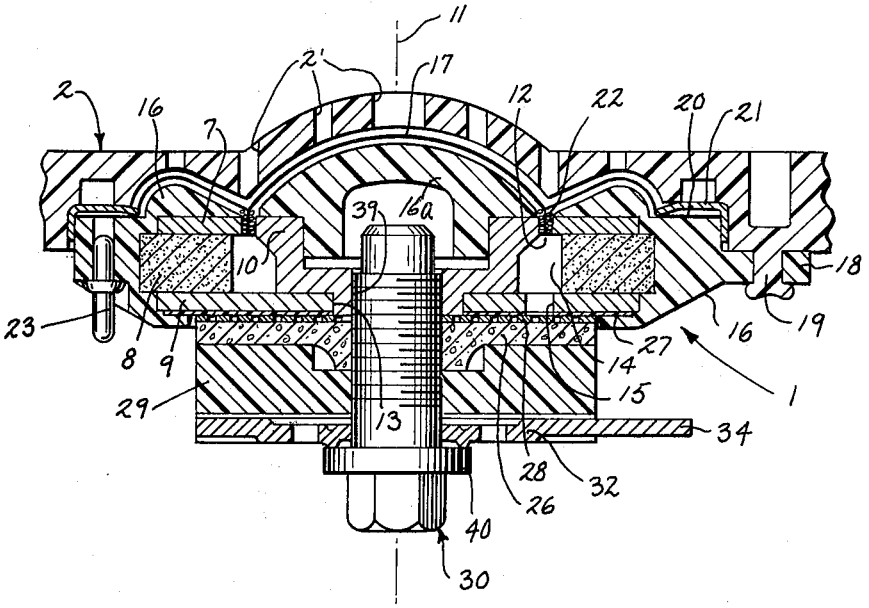
FIG. 1 is a view in cross section of a first preferred embodiment of the transducer which forms a part of the invented headphone taken along a line which includes the sound emitting axis, a port, and a terminal post.
Figure 2:
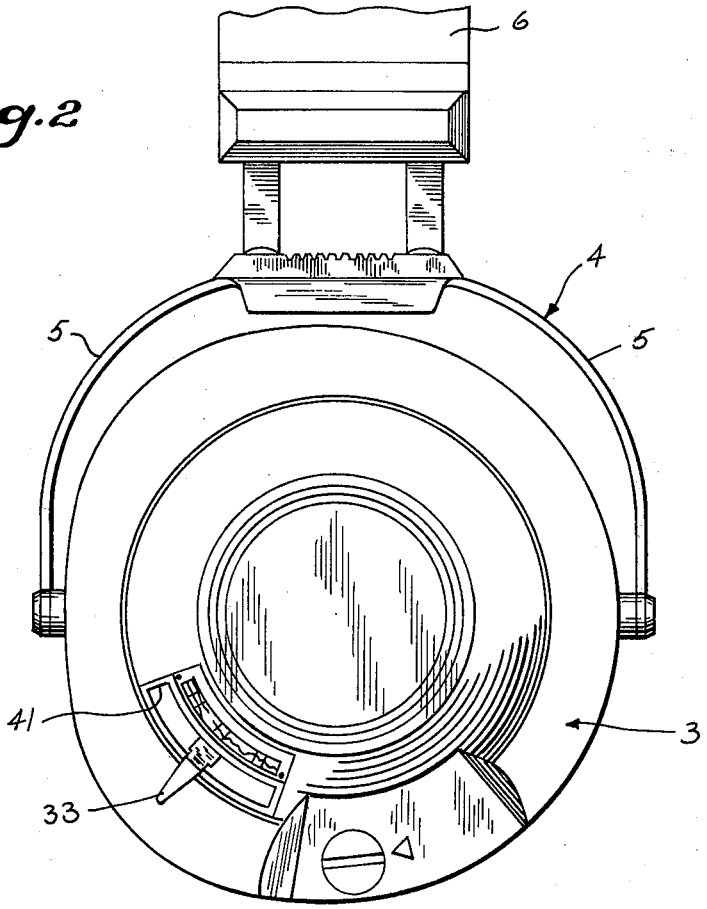
FIG. 2 is an elevation view of a headphone cup which incorporates the audio transducer of FIG. 1.
Figure 3:
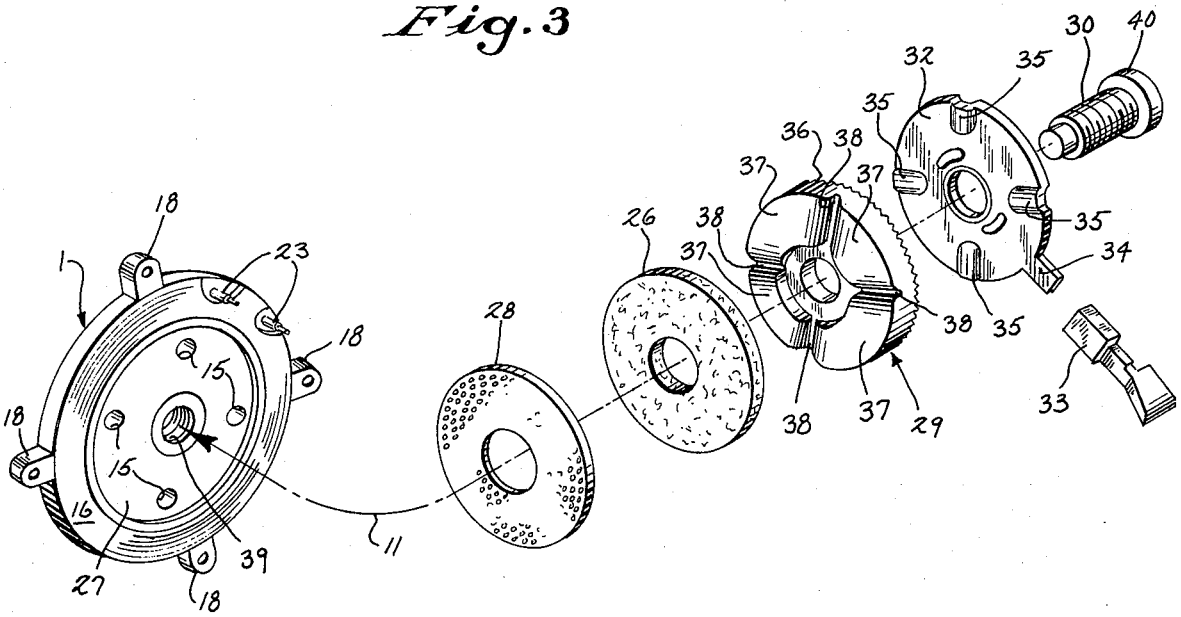
FIG. 3 is an exploded perspective view of the audio transducer of FIG. 1.

Referring to FIGS. 1–3, an audio transducer 1 is mounted to a molded plastic face plate 2 which forms part of an enclosed headphone cup 3. The cup 3 is journaled to a metal bracket 4 which includes two arms 5 that extend downward and around the cup 3 to rotatably attach on opposite sides of its rim. The bracket 4 makes an adjustable connection to a headband 6 which in turn connects to a second similar bracket and headphone cup (not shown in the drawings) to form a stereophone which is suitable for placement over the head of a listener. Numerous stereophone structures are known to the art for supporting a pair of enclosed audio transducers over the ears of a listener.

Referring particularly to FIGS. 1 and 3, the audio transducer 1 includes a magnetic circuit comprised of an annular shaped outer pole piece 7, a ring magnet 8, a back plate 9 and an inner pole piece 10. A ring magnet 8 is disposed concentric about a sound emitting axis 11 and is preferrably made of a magnetically hard, oriented ferrite ceramic, or a metal alloy material that is polarized in a direction substantially parallel to the sound emitting axis 11. The outer pole piece 7 is retained to the front surface of the ring magnet 8 and it extends radially inward therefrom to define one boundary of an annular air gap 12. The outer pole piece 7 is made of a high permeability material such as low carbon steel. The back plate 9 is retained against the back surface of the ring magnet 8 and it extends radially inward therefrom a substantial distance. The back plate 9 is also made of a high permeability material and it defines a circular central opening 13 into which the inner pole piece 10 snugly fits. The inner pole piece 10 is also made of a high permeability material and it extends forward from the back plate 9 and radially outward toward the outer pole piece 7 to define the inner boundary of the annular air gap 12. The magnetic circuit thus formed defines an annular chamber 14 located immediately behind the air gap 12, and a set of four circular openings, or ports, 15 are formed in the back plate 9 to vent the chamber 14. The ports 15 are spaced equidistantly about the sound emitting axis 11.

The magnetic circuit is held together by a molded plastic encapsulation material 16 which wraps around the circular outer perimeters of the back plate 9, ring magnet 8 and outer pole piece 7. The encapsulation 16 also extends around the front surface of the outer pole piece 7 and it forms a central dome element 16*a* which covers the front surface of the inner pole piece 10. A set of four ears 18 are formed during the encapsulation process and extend radially outward to provide mounting elements. Openings are formed in the ears 18 which receive posts 19 that are integrally formed to the back surface of the molded plastic face plate 2. The encapsulated magnetic circuit is fastened to the face plate 2 by hot staking the posts 19.

A diaphragm 17 made of a thin sheet of plastic film, such as polyester, is shaped to cover the contoured front surface of the encapsulated magnetic circuit and is held in place by a resilient metal fastener 21 that engages a flange 20 and extends around the circular outer perimeter of the encapsulation 16. A circular voice coil 22 is attached to the diaphragm 17 and it extends rearward into the annular air gap 12. The ends of the voice coil 22 are electrically connected to a pair of terminal posts 23. The diaphragm 17 is thus supported around its periphery for reciprocatable motion in a chamber formed between the encapsulated magnetic circuit and the face plate 2. As is well known in the art, when an audio signal is applied to the voice coil 22 the diaphragm 17 is caused to reciprocate and emit sound generally in the direction of the sound emitting axis 11. A series of openings 2′ are formed in the face plate 2 to allow the sound emitted from the front surface of the diaphragm 17 to reach the ear of the listener.

Figure 5:
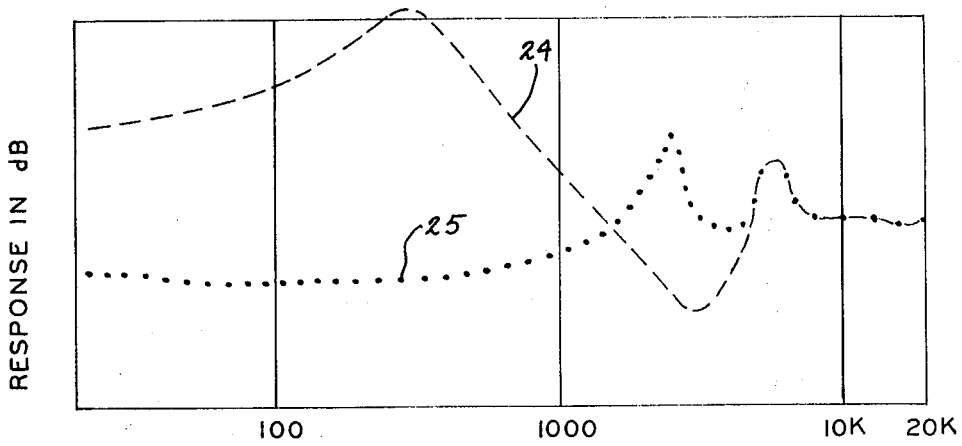
FIGS. 5 and 6 are graphs which illustrate typical frequency response curves of the transducer of FIG. 1.

Referring particularly to FIG. 5, it is well known in the art that the frequency response of the above described audio transducer can be substantially affected by the amount of acoustical resistance placed over the ports 15. For example, the response curve indicated by the dashed lines 24 illustrates the substantial bass boost which occurs when the ports 15 are undamped, or left open. On the other hand, when the ports 15 are fully damped, or closed, the response curve indicated by the dotted line 25 results. In prior headphone structures, a damping material is fixed over the ports 15 during manufacture and a single predetermined response curve is thus achieved. Typically, a response curve between the extremes shown by the lines 24 and 25 is chosen.

Although an audio transducer has been shown and described in detail, it forms no part of the invention except insofar as it constitutes an audio transducer having ports which couple to the back of the diaphragm and which substantially affect the frequency response of the audio transducer when the acoustical resistance thereof is changed. Other types of audio transducers can be used such as electrostatic transducers, piezoelectric transducers or other dynamic transducers having different magnetic circuit structures.

Referring particularly to FIGS. 1 and 3, the present invention resides in the placement of an acoustic damping material made of a resilient material over the ports 15 and the provision of an adjustable clamp which applies an adjustable compressive force to the damping material to affect the acoustical resistance thereof. The acoustic damping material is in the form of a circular pad 26 which is made of a resilient and porous material such as rubber or plastic foam. A reticulated, or open cell, foam rubber or plastic is preferred since the acoustic resistance thereof increases substantially as it is compressed and its open cells gradually close.

The adjustable clamp which retains the acoustical damping material 26 to the rear surface of the audio transducer 1 includes a molded plastic compression plate 29, a threaded shaft 30 and a coupling mechanism 31 formed by a coupling plate 32 and a lever 33. The threaded shaft 30 is molded from a plastic material and it extends through openings in the other elements and is received in a threaded opening 39 formed in the back of the transducer 1 at its center. The threaded shaft 30 includes a flange 40 which retains the elements of the adjustable clamp to the rear surface of the transducer 1, but which allows their rotation about the sound emitting axis 11.

The coupling plate 32 is stamped from sheet aluminum and has a circular shape interrupted by an outward extending arm 34. The lever 33 is made of a molded plastic and includes an opening at its end which tightly receives the arm 34. As shown best in FIG. 2, the lever 33 extends radially outward from the sound emitting axis 11 through a slot 41 formed along the perimeter of the headphone cup 3. The slot 41 is sufficiently long to allow the listener to rotate the adjustable clamp about ⅛ revolution about the central sound emitting axis 11. A set of four cleats 35 are formed on the front surface of the coupling plate 32 and these engage a radially serrated back surface 36 on the compression plate 29. The compression plate 29 is molded from a plastic material and has a circular outer surface which is substantially coextensive with the outer surfaces of the coupling plate 32 and the acoustic damping material 26. The front surface of the compression plate 29 is contoured to form four substantially identical curved surfaces 37 bounded by four radially directed cusps 38.

The acoustical damping material 26 is compressed between the contoured surface on the compression plate 29 and a screen 28. The metallic screen 28 is circular in shape and it provides an acoustically transparent barrier that prevents the damping material 26 from entering the ports 15 and being damaged during rotation. Rotation of the screen 28 with respect to the back surface of the transducer 1 is enhanced by a layer 27 of a polytetraflouroethylene material such as Teflon which is formed on the surface of the back plate 9.

The degree to which the damping material 26 is compressed is determined by the shape of the compression plate 29 and it varies from a minimum compression immediately forward of the four cusps 38 to a maximum compression at the four points intermediate the cusps 38. As a result, the acoustic resistance disposed over the ports 15 varies as a function of the angular orientation of the compression plate 29 and acoustical resistance material 26. In other words, when the cusps 38 are aligned directly over the ports 15 a minimal acoustic resistance is provided by the damping material 26, but by rotating the compression plate 29 ⅛ turn in either direction, the areas of maximum compression are aligned over the ports 15. The cells in the acoustic damping material 26 are substantially closed at the points of maximum compression and the ports 15 are, therefore, essentially closed to provide maximum damping. Thus, by rotating the compression plate 29 about the sound emitting axis 11 the frequency response of the audio transducer 1 can be altered from a condition approaching that of minimum damping shown by the dashed line 24 in FIG. 5 to a condition approaching that of maximum damping as shown by the dotted line 25.

Figure 6:
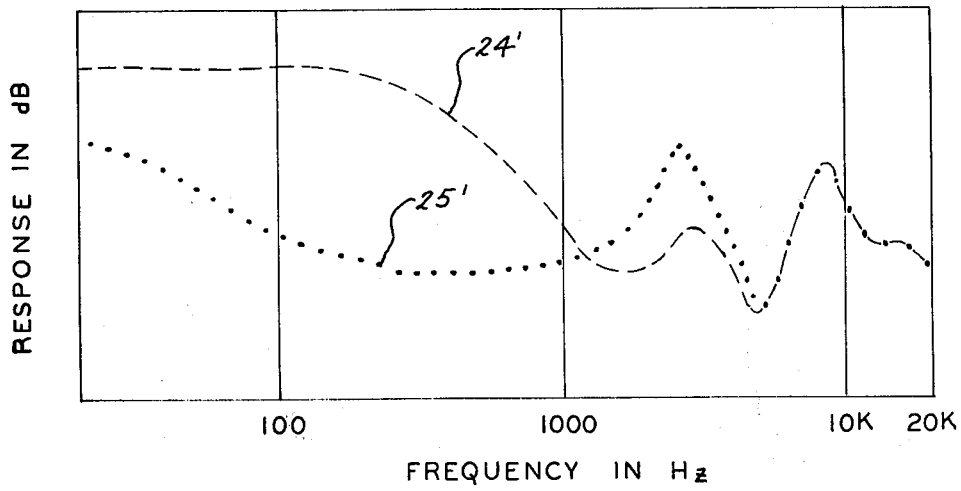

In practice, the two extreme curves shown in FIG. 5 are difficult to achieve and are of limited usefulness. Instead, by the proper selection of damping material and by the proper control of its compression as described above, a more useful range as illustrated by curves 24′ and 25′ in FIG. 6 can be obtained. A continum of frequency response curves can be achieved by moving the lever 33 and positioning the compression plate 29 between its two extreme orientations. The curved surfaces 37 on the compression plate 29 of the preferred embodiment are shaped to provide substantially equal changes in the frequency response curve of the audio transducer 1 for incremental movements of the lever 33 over the entire ⅛ revolution. Although this linear "taper" is preferred, it should be apparent that other satisfactory responses can be achieved by using compression plates having different contoured surfaces.

Figure 4:
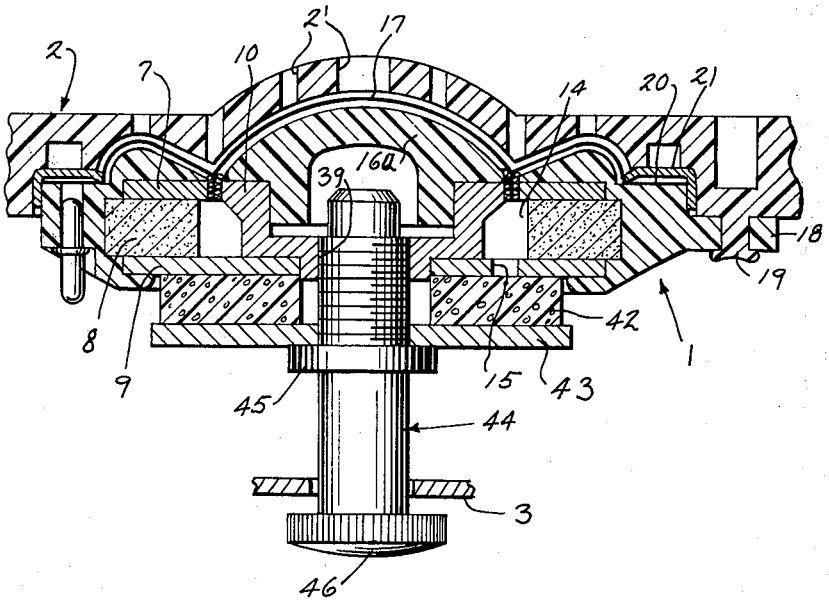
FIG. 4 is a view in cross section of a second preferred embodiment of the audio transducer taken along a plane which includes its sound emitting axis.

Referring particularly to FIG. 4, a second preferred embodiment of the invention is shown in which a different form of adjustable clamping means is employed. The same audio transducer 1 is used and the elements which correspond to those described above have been indicated with the same reference numbers. As in the first preferred embodiment, a circular pad 42 of an acoustical damping material is held in place over the ports 15 by a circular compression plate 43. The compression plate 43, however, is substantially flat on both of its surfaces and it includes a central opening through which a molded plastic threaded shaft 44 extends. A flange 45 on the shaft 44 clamps the compression plate 43 and acoustical resistance pad 42 against the back surface of the audio transducer 1, but does not rotate them. The threaded shaft 44 extends rearward through an opening in the cup 3 and a knob 46 is fastened to its exposed end. By turning the knob 46 the spacing between the compression plate 43 and the back plate 9 on the audio transducer 1 can be changed to alter the compression of the damping material 42 and, therefore, its acoustic resistance. The frequency response of the audio transducer 1 can thus be varied between a substantially undamped condition in which the pad 42 is merely retained in place by the threaded shaft 44 to a highly damped condition in which its cells are closed under the compressive force of the plate 43.

We claim:

1. In an audio transducer for a headphone having ports which couple the back surface of the transducer diaphragm to the interior of the headphone cup, the improvement comprising:

an acoustic damping material made of a resilient material which is disposed over said ports to affect the acoustic resistance thereof;

an adjustable clamp mounted to said audio transducer and including a compression plate which bears against said acoustic damping material to provide a compressive force which can be varied to adjust the acoustic resistance of said acoustic damping material; and means coupling said adjustable clamp through an opening in the headphone cup to allow adjustment of the acoustic resistance of said ports from the exterior of said cup.

2. The improvement as recited in claim 1 in which said compression plate is mounted for rotation about a central sound emitting axis and the acoustic damping material is disposed between the back of the audio transducer and a contoured front surface on said compression plate.

3. The improvement as recited in claim 2 in which there are a plurality of ports disposed concentrically about said sound emitting axis and said contoured front surface includes a corresponding number of substantially identical curved surfaces which each cooperate with one of said ports.

4. The improvement as recited in claim 2 in which said coupling means includes a lever which extends radially outward from said sound emitting axis and through a slot in the periphery of said cup.

5. The improvement as recited in claim 4 in which said coupling means includes a coupling plate which engages a rear surface on said compression plate to impart rotary motion thereto when said lever is moved along said slot.

6. The improvement as recited in claim 1 in which said adjustable clamp includes a shaft which extends through a central opening in said compression plate and through a central opening in said acoustic damping material and is received in an opening formed on the back of said audio transducer which is concentric with a central sound emitting axis, and there are a plurality of ports disposed concentrically about said sound emitting axis.

7. In a headphone, the combination comprising:

a cup having a face plate with an opening which couples to the ear canal of a user when the headphones are in place;

an audio transducer mounted within the cup and having a diaphragm which radiates sound from its front surface through said face plate opening when supplied with an audio signal, said audio transducer including a chamber located within said audio transducer to the rear of said diaphragm and a set of ports which couple said chamber to the interior of said cup;

an acoustic damping material made of a resilient material which is disposed over said ports to provide acoustic resistance to sound emitted from the rear surface of said diaphragm through said ports;

an adjustable clamp mounted to the rear of said audio transducer and including a compression plate which engages said damping material to selectively compress said material and to thereby affect the magnitude of said acoustic resistance; and a coupling mechanism connected to said adjustable clamp and including manipulative means extending through an opening in said cup providing access thereto by the headphone user, said coupling mechanism imparting motion to said compression plate to change said acoustic resistance when said manipulative means is moved by the headphone user.

8. The headphone as recited in claim 7 in which said ports are disposed around a central sound emitting axis and said adjustable clamp is fastened to the back of the audio transducer by a shaft which is received in an opening formed in the back of the audio transducer concentric about the central sound emitting axis, and wherein the acoustic damping material is disposed around said shaft and is variably compressed between said compression plate and the back surface of said audio transducer.

9. The headphone as recited in claim 7 in which a screen is disposed between the back surface of said audio transducer and the acoustic damping material and said damping material is an open cell foam rubber.

10. The headphone as recited in claim 8 in which the front surface of said compression plate is contoured to vary the amount which the acoustic damping material is compressed as a function of the circumferential distance about said central sound emitting axis and said coupling mechanism is operable to rotate said compression plate and said acoustic damping material about said central sound emitting axis.

11. In an audio transducer for a headphone having a set of ports disposed around a central sound emitting axis and coupled with the rear surface of a transducer diaphragm to affect the frequency response thereof, the improvement therein comprising:

an acoustic damping material made of a resilient material which is disposed over said ports to provide acoustic resistance to sound emitted from the rear surface of said diaphragm through said ports;

a compression plate mounted to said transducer for rotation about said central sound emitting axis, said compression plate having a contoured surface which engages said acoustic damping material and which alters its acoustic resistance as a function of circumferential distance around said sound emitting axis; and means for rotating said compression plate about said central sound emitting axis.

12. The improvement as recited in claim 11 in which said compression plate is rotatably supported by a shaft which extends rearward from the back of said transducer and which is coaxial with said central sound emitting axis, said shaft passing through an opening in said acoustic damping material.

13. The improvement as recited in claim 12 in which said ports are disposed equidistantly about said central sound emitting axis and said contoured surface includes a corresponding number of cusps which are disposed equidistantly about said central sound emitting axis.

14. The improvement as recited in claim 13 in which a substantially acoustically transparent screen is disposed between the back surface of said transducer and said acoustic damping material, and said screen and said acoustic damping material are coupled to rotate with said compression plate about said central sound emitting axis.

15. The improvement as recited in claim 11 in which said means for rotating said compression plate includes a coupling plate that engages the rear surface of said compression plate and includes a lever which extends radially outward from said central sound emitting axis.

* * * * *